US005199227A

United States Patent [19]

Ohishi

[11] Patent Number: 5,199,227

[45] Date of Patent: Apr. 6, 1993

[54] SURFACE FINISHING TAPE

[75] Inventor: Michihiro Ohishi, Sagamihara, Japan

[73] Assignee: Minnesota Mining and Manufacturing Company, St. Paul, Minn.

[21] Appl. No.: 849,933

[22] Filed: Mar. 12, 1992

Related U.S. Application Data

[62] Division of Ser. No. 624,569, Dec. 10, 1990, Pat. No. 5,147,416.

[30] Foreign Application Priority Data

Dec. 20, 1989 [JP] Japan ..... 1-330470

[51] Int. Cl.[5] ..... B24B 11/00

[52] U.S. Cl. ..... 51/395; 51/293; 51/298

[58] Field of Search ..... 51/394, 395, 397, 396, 51/401, 407, 295, 293, 298

[56] References Cited

U.S. PATENT DOCUMENTS

| | | | |
|---|---|---|---|
| 4,114,322 | 9/1978 | Greenspan | 51/206 |
| 4,751,797 | 6/1988 | Fujimori | 51/395 |
| 4,762,534 | 8/1988 | Ito et al. | 51/293 |
| 4,773,970 | 9/1988 | Chasman et al. | 51/295 |
| 4,836,832 | 6/1989 | Tumey et al. | 51/293 |
| 4,842,618 | 6/1989 | Ito et al. | 51/293 |
| 4,867,757 | 9/1989 | Payne | 51/293 |
| 5,014,468 | 5/1991 | Ravipati et al. | 51/295 |
| 5,028,242 | 7/1991 | Ito et al. | 51/295 |

FOREIGN PATENT DOCUMENTS

| | | | |
|---|---|---|---|
| 0079576 | 4/1986 | Japan | 51/295 |
| 0094272 | 4/1987 | Japan | 51/295 |
| 62-130168 | 6/1987 | Japan . | |
| 2199364 | 9/1987 | Japan | 51/295 |
| 2255069 | 11/1987 | Japan | 51/295 |
| 3185577 | 8/1988 | Japan | 51/295 |
| 3267169 | 11/1988 | Japan | 51/295 |
| 1-266838 | 4/1989 | Japan . | |
| 2043501A | 2/1979 | United Kingdom . | |
| 2164053A | 6/1985 | United Kingdom . | |

*Primary Examiner*—Robert A. Rose

*Attorney, Agent, or Firm*—Gary L. Griswold; Walter N. Kirn; Richard Francis

[57] ABSTRACT

A surface treating tape has a sheet-like backing covered with closely spaced protuberances which are coated with an abrasive layer which contains premium abrasive particles. The surface finishing tape is useful for finishing magnetic disks and other substrates to provide a percision finish.

14 Claims, 1 Drawing Sheet

SURFACE FINISHING TAPE

This is a division of application Ser. No. 07/624,569, filed Dec. 10, 1990, now U.S. Pat. No. 5,147,416.

FIELD OF THE INVENTION

The present invention relates to a surface finishing tape suitable for polishing or lapping various articles, particularly for finishing the surface of magnetic disks, precision parts, machinery and tools. The invention also provides a method of making the surface finishing tape.

BACKGROUND ART

Various techniques are known to provide a precision finish without introducing flaws to the finished surface. It is known to apply abrasive particles of diamond blended with other abrasive particles such as aluminum oxide or silicon carbide in a finishing or rubbing tape which has debris-collecting pockets (Japanese Laid Open application No. 130168/87, published Jun. 12, 1987). Furthermore, it is known to provide a surface finishing tape which has at least two abrasive layers each with different grinding properties (Japanese Laid Open Application No. 109084/89, published Apr. 26, 1989).

It is also known to make an abrasive sheet or polishing sheet containing an abrasive layer divided into discrete blocks by a network of grooves (U.S. Pat. No. 4,751,797).

The surface finishing tapes of the prior art generally utilized premium abrasive grains such as diamond or cubic boron nitride abrasive particles but such tapes are less effective because they contain the premium abrasive grains distributed throughout the thickness of the abrasive layer. Since it is only the surface abrasive grains that do the actual surface finishing, the premium abrasive grains contained within the abrasive layer were generally never afforded an opportunity to contact the work piece being finished.

Usually because of the high cost of the more premium abrasive material, it is desirable to optimize its utility in a surface finishing tape. While some of these references attempt to optimize the performance of the more premium abrasive material (diamond or cubic boron nitride), such attempts have had minimal effectiveness.

The layering of different abrasive grains on a surface finishing tape also has its drawbacks because such layering requires continued adhesion during use of a top layer onto a base layer which could separate in use to minimize the effect of the premium abrasive in the upper layer or introduce flaws as the top layer is delaminating.

SUMMARY OF THE INVENTION

The present invention provides a surface finishing tape which is suitable for lapping or polishing various substrates to provide a precision finish which has maximum utility of the premium abrasive grain contained therein and which does not introduce flaws to the surface being finished. The surface finishing tape of the present invention comprises a backing which bears closely spaced protuberances which are coated with an abrasive layer which contains premium abrasive grain such that the areas between protuberances provide grinding debris-collecting grooves or pockets.

More specifically, the finishing tape of the invention comprises a base portion having a sheet-like backing one surface of which is covered with an assemblage composed of a plurality of closely spaced protuberances. Adjacent protuberances are separated by narrow spaces. The protuberances are covered by an abrasive layer which contains premium abrasive particles such as diamond or cubic boron nitride abrasive particles in a binder. The surface of each protuberance is covered with the abrasive layer without completely filling the narrow spaces therebetween. The unfilled spaces provide grinding debris-collecting grooves between abrasive-covered protuberances.

The surface finishing tape of the invention is made by:

(a) preparing a mixture of a curable resin, solid particles and volatile solvent;

(b) coating the solution of (a) onto a sheet-like backing;

(c) evaporating the volatile solvent from the solution to form a residual layer of curable resin having convection or Benard cells on the sheet-like backing;

(d) curing the residual layer of curable resin to form closely spaced protuberances separated by narrow openings on the sheet-like backing;

(e) coating the protuberances with a dispersion of curable binder resin and abrasive material so as to produce an abrasive layer which on curing the curable binder forms an abrasive layer over the protuberances without filling the narrow spaces; and (f) curing the curable binder resin.

BRIEF DESCRIPTION OF DRAWING

The invention is further illustrated by reference to the drawing in which.

DETAILED DESCRIPTION

Figure 1:
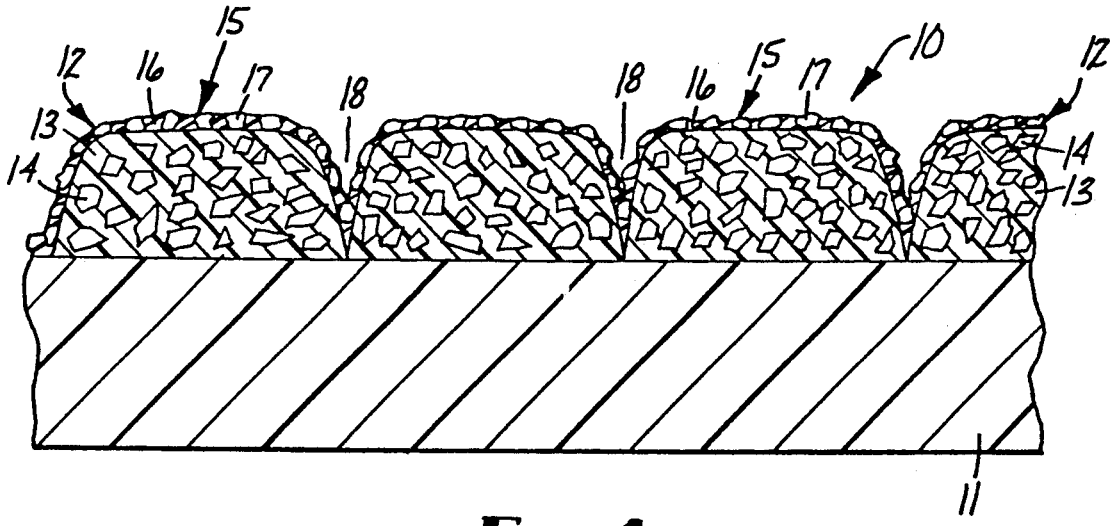
FIG. 1 an enlarged cross-sectional view of the surface finishing tape in accordance with the invention.

Referring to FIG. 1, there is shown an enlarged cross-sectional view of a surface finishing tape 10 in accordance with the present invention. Tape 10 includes a sheet-like backing 11 which is covered by a plurality of closely spaced protuberances 12, each of which may be comprised of a binder material 13 which may be filled with solid particulate material 14. The exposed surface of the protuberances is covered by an abrasive layer 15 which is composed of binder 16 which contains premium abrasive grains 17. Protuberances 12 have spaces 18 therebetween which remain even after covering the surfaces of protuberances 12 with abrasive layer 15.

The preferred premium abrasive particles contained in the abrasive layer of the surface finishing tape in accordance with the invention are either diamond or cubic boron nitride. When the substrate being finished is iron or the like, which is reactive with diamond particles, it is preferred to replace all or part of the diamond abrasive particles with cubic boron nitride abrasive particles. In some instances, it may also be desirable, depending upon the physical properties of the surface being finished and the surface finish desired, to mix the premium abrasive grains with other abrasive grains such as fused or ceramic aluminum oxide abrasive particles.

The preferred average diameter of the abrasive particles for the surface finishing tape of the present invention on the order of 0.1 to 100 μm, preferably 0.5 to 50 μm.

Binder 16 which contains the premium abrasive grains in abrasive layer 15 may be any conventional binder material suited for this purpose. Suitable binder materials include those made of thermosetting resins, thermoplastic resins, rubber resins, electron beam curable resins, and ultraviolet curable resins. Preferred binder materials include thermosetting resins, electron beam curable resins and ultraviolet curable resins. A useful curable resin solution is provided by 13 parts by weight saturated polyester resin which is commercially available under the trade designation VITEL PE307 (by Goodyear Company), 3 parts by weight trifunctional isocyanate curing agent which is commercially available under the trade designation "COLONATE L" (by Nippon Polyurethane Company), and a solvent mixture of 13 parts by weight toluene and 48 parts by weight methylethyl ketone. Most preferably, the binder resin for the abrasive layer is the same as binder material 13 from which protuberances 12 are formed to promote optimum adhesion and delamination resistance between the abrasive layer and the protuberance surface.

Sheet-like backing 11 may be any compatible sheet material such as polymeric film formed, for example, of polyethylene terephthalate, polyimide, polycarbonate, or their surface-treated products, paper, for example, made of synthetic fibers, and non-woven fabrics. The preferred sheet sheet-like backing is formed of polyethylene terephthalate because of its dimensional stability, flexibility and solvent resistance. Films having a thickness on the order of 25 μm are most preferred.

The composition of binder material 13 which forms protuberances 12 may be selected from any of those materials suggested above for providing binder material 16 for abrasive layer 15. These, as previously mentioned, include thermosetting resins, thermoplastic resins, rubber resins, electron beam curable resins, and ultraviolet curable resins. Thermosetting resins, electron beam curable resins and ultraviolet curable resins are particularly preferred. The curable binder should be solvent soluble or dispersible in order to obtain a dispersion of the curable binder and solvent so that on drying by solvent evaporation it will form protuberances 12. A useful curable binder resin solution is provided by 13 parts by weight saturated polyester resin which is commercially available under the trade designation VITEL PE307 (by Goodyear Company), 3 parts by weight trifunctional isocyanate curing agent which is commercially available under the trade designation "COLONATE L" (by Nippon Polyurethane Company), and a solvent mixture of 13 parts by weight toluene and 48 parts by weight methylethyl ketone.

The protuberances may include particulate filler material to reduce cost. Such particulate filler material may include solid particles selected from the group consisting of silica, talc, aluminum hydroxide, clay, barium sulfate, aluminum oxide, silicon carbide, boron nitride, chromium oxide, iron oxide and calcium carbonate The particle size of the filler particles is preferably on the order of 0.1 to 100 μm.

A surface finishing tape in accordance with the present invention is prepared by first mixing particles of filler material such as silica, talc, calcium carbonate, aluminum oxide or the like with a binder material and solvent This slurry is maintained by mixing with an appropriate mixer. The slurry is then coated onto the sheet-like backing such polyethylene terephthalate by the use of any of a variety of conventional coaters which are capable of providing a slurry coating at a controlled thickness. Such coating equipment may include a Mayer bar coater, a gravure coater, a reverse-roll coater, knife coater or the like. The coating is then dried in a conventional drying oven at a temperature which will rapidly evaporate the of the protuberance. A drying temperature of 100°-110° C. is preferred.

The dried slurry coat leaves on the backing dome-like, doughnut-like or block-like protuberances which are formed by the convection cells produced during solvent evaporation in a dryer.

A slurry of the premium abrasive grains such as diamond or cubic boron nitride, binder resin and solvent, if needed, is applied over the protuberant-covered backing by conventional coating techniques to provide on drying an abrasive layer. Such coating may be accomplished by use of a roll coater, knife coater or the like. A limited amount of the abrasive grain-containing slurry is applied so that the space between protuberances is not filled. The coating is sufficiently thick, however, to provide an abrasive layer which contains an adequate amount of the premium abrasive grains to accomplish the desired finishing when the surface finishing tape is utilized.

EXAMPLES

The present invention is illustrated by the following non-limiting examples wherein all parts and percentages are by weight unless otherwise specified.

EXAMPLE

First, a slurry consisting of 34 parts of silica particles having a particle size of 3 μm, 13 parts of a saturated polyester resin, 3 parts tri-functional isocyanate and 50 parts of methylethylketone/toluene solvent blend in a weight ratio of 3:2 was applied on a 25 μm thick polyethylene terephthalate film by means of a knife coater to provide a wet coating weight of 45 g/m$^2$. Then, this coated film was dried in a drying oven at 100°~130° C. to evaporate the solvent and further cured by heating at 70° C. for 36 hours. The dried coating produced irregularly-shaped protuberances because of the convection cells produced during the evaporation process of the solvent. A slurry of the composition described in TABLE I was then coated over the dried protuberances carried on the polyethylene terephthalate film by means of a knife coater to provide a wet coating weight of 19 g/m$^2$. The resultant coated article was then dried in a drying oven at 100° to 110° C. to substantially remove solvent and further cured by heating at 70° C. for 36 hours. The resultant surface finishing tape had a cross section as depicted in FIG. 1 of the drawing.

TABLE I

| Ingredients | Parts |
|---|---|
| Diamond Abrasive Particles (De Beers SND, Particle Size 2-4 μm) | 5 |
| Saturated Polyester Resin VITEL PE307 (by Goodyear Company) | 13 |
| Trifunctional Isocyanate Curing Agent Colonate L (by Nippon Polyurethane Co.) | 3 |
| Methylethylketone Solvent | 48 |
| Toluene Solvent | 31 |

PERFORMANCE TEST

The abrasive sheet materials described in the following examples were cut into 150 by 2.54 cm tapes which were used in a test to polish the plated surface of a NiP plated 13.3 cm (5.25 inch) diameter aluminum disk. The disk was rotated at 200 rpm while contacting the plated face with a test abrasive tape which was urged for a period of 40 seconds under a load of 750 g against the disk surface at a speed of 8 mm/second by a 25.4 mm diameter backup roll. The plated disk was weighed before and after polishing to determine the amount of stock abraded by the test sample. The result is shown in TABLE II.

COMPARATIVE EXAMPLE 1

A surface finishing tape on which no surface protuberant pattern was prepared in a similar manner as described in the Example of the invention, except that a slurry having a composition as shown in TABLE I was directly applied to the 25 μm thick polyethylene terephthalate film. The resulting abrasive coating was dried and cured as described in the Example and the resultant surface finishing tape subjected to the polishing test. Polishing test results are shown in TABLE II.

COMPARATIVE EXAMPLE 2

A slurry consisting of 37 parts of alumina abrasive particles having a particle size of 3 μm, 10.5 parts of the saturated polyester binder resin described in the Example, 2.5 parts of the trifunctional isocyanate described in the Example, and 50 parts of methylethylketone/toluene solvent in a weight ratio of 48/31 was applied on a 25 μm thick polyethylene terephthalate film by means of a knife coater to provide a wet coating weight of 45 g/m$^2$. The coated film was heat-dried in an oven to evaporate the solvent, as described in the Example of the invention, to produce protuberances on the film. The coating was then cured at 70° C. for 36 hours. The resulting surface finishing tape had a protuberant covered surface as described in the Example according to the invention except it contained alumina abrasive particles. The result of testing this surface finishing tape in the polishing test is described in TABLE II.

TABLE II

| Example | Presence of Protuberances (yes or no) | Amount Abraded After 40 Seconds (mg) |
|---|---|---|
| According to the Invention | Yes | 5.7 |
| Comparative No. 1 | No | 2.3 |
| Comparative No. 2 | Yes | 0.9 |

From TABLE II it is apparent that the abrading performance of the surface treating tape according to the present invention is very high in comparison with the abrading performance of the comparative examples.

I claim:

1. A surface finishing tape comprising:

(a) a base portion having a sheet-like backing one surface of which is covered with an assemblage composed of a plurality of closely spaced protuberances, adjacent protuberances being separated by narrow spaces, wherein said protuberances are comprised of a mixture of binder and solid particles which are selected from the group consisting of silica, talc, aluminum hydroxide, clay, barium hydroxide, aluminum oxide, silicon carbide, boron nitride, chromium oxide, iron oxides, calcium carbonate and mixtures thereof; and (b) an abrasive layer which contains premium abrasives particles in a binder covering the surface of each of said protuberances without completely filling said narrow spaces whereby to provide grinding debris-collecting grooves between abrasive-covered protuberances.

2. The surface finishing tape of claim 1 wherein said premium abrasive grains are comprised of a hard material selected from the group consisting of diamond and cubic boron nitride.

3. The surface finishing tape of claim 1 wherein said abrasive particles have an average particle size in the range of 0.1 to 100 μm.

4. The surface finishing tape of claim 1 wherein said sheet-like backing is polyethylene terephthalate film.

5. The surface finishing tape of claim 1 wherein said protuberances comprise saturated polyester resin cured with trifunctional isocyanate.

6. The surface finishing tape of claim 1 wherein said binder resin comprises saturated polyester resin cured with trifunctional isocyanate.

7. The surface finishing tape comprising:

(a) a base portion having a sheet-like backing one surface of which is covered with an assemblage composed of a plurality of closely spaced protuberances comprised of Benard cells, adjacent protuberances being separated by narrow spaces; and (b) an abrasive layer which contains premium abrasive particles in a binder covering the surface of each of said protuberances without completely filling said narrow spaced whereby to provide grinding debris-collecting grooves between abrasive-covered protuberances.

8. The surface finishing tape of claim 7 wherein said premium abrasive grains are comprised of a hard material selected from the group consisting of diamond and cubic boron nitride.

9. The surface finishing tape of claim 7 wherein said protuberances are comprised of a mixture of binder and solid particles.

10. The surface finishing tape of claim 9 wherein said solid particles are selected from the group consisting of silica, talc, aluminum hydroxide, clay, barium hydroxide, aluminum oxide, silicon carbide, boron nitride, chromium oxide, iron oxide, calcium carbonate and mixtures thereof.

11. The surface finishing tape of claim 7 wherein said abrasive particles have an average particle size in the range of 0.1 to 100 μm.

12. The surface finishing tape of claim 7 wherein said sheet-like backing is polyethylene terephthalate film.

13. The surface finishing tape of claim 7 wherein said protuberances comprise saturated polyester resin cured with trifunctional isocyanate.

14. The surface finishing tape of claim 7 wherein said binder resin comprises saturated polyester resin cured with trifunctional isocyanate.

* * * * *